United States Patent [19]

Hameyer et al.

[11] 4,209,451

[45] Jun. 24, 1980

[54] PROCESS FOR THE MANUFACTURE OF MIXED ESTERS FROM HYDROXYCARBOXYLIC ACIDS AND PARTIAL GLYCERIDES OF FATTY ACIDS

[75] Inventors: Peter Hameyer; Theodor Tomczak, both of Essen, Fed. Rep. of Germany

[73] Assignee: Th. Goldschmidt AG, Essen, Fed. Rep. of Germany

[21] Appl. No.: 923,988

[22] Filed: Jul. 12, 1978

[30] Foreign Application Priority Data

Jul. 16, 1977 [DE] Fed. Rep. of Germany ..... 2732210

[51] Int. Cl.[2] ..... C11C 3/02

[52] U.S. Cl. ..... 260/410.8; 260/410.7

[58] Field of Search ..... 260/410.7, 410.8; 426/611

[56] References Cited

U.S. PATENT DOCUMENTS

| | | | |
|---|---|---|---|
| 2,480,332 | 8/1949 | Little | 260/410.8 |
| 2,509,414 | 5/1950 | Barsky | 260/410.8 X |
| 2,690,971 | 10/1954 | Iveson | 260/410.8 X |
| 2,938,027 | 5/1960 | Gladstone | 260/410.8 X |
| 2,978,329 | 4/1961 | Cochran | 260/410.8 X |

*Primary Examiner*—John F. Niebling

*Attorney, Agent, or Firm*—Toren, McGeady and Stanger

[57] ABSTRACT

A method for manufacturing mixed esters from hydroxycarboxylic acids and partial glycerides of fatty acids which possess a high degree of hydrophilicity and good odor and taste by esterifying fruit acids with lactic acid and a partial glyceride of a fatty acid in either a single or separate step.

5 Claims, No Drawings

PROCESS FOR THE MANUFACTURE OF MIXED ESTERS FROM HYDROXYCARBOXYLIC ACIDS AND PARTIAL GLYCERIDES OF FATTY ACIDS

BACKGROUND OF THE INVENTION

1. Field of the Invention

The invention relates to a process for the manufacture of mixed esters from hydroxycarboxylic acids and partial glycerides of fatty acids. In particular, the invention relates to the manufacture of mixed esters from hydroxycarboxylic acids and partial glycerides of fatty acids with a high degree of hydrophilicity. The term fatty acid means an alkylcarboxylic acid with 8 to 18 carbon atoms, which may be saturated or unsaturated. The term partial glycerides means mono- and/or diesters of glycerine.

2. Description of the Prior Art

The use of mixed esters from hydroxycarboxylic acids and partial glycerides of fatty acids for solving emulsifying and wetting problems in the pharmaceutical, cosmetic, food and animal food fields is well known. At the same time, the use of hydroxycarboxylic acids which are physiologically safe is both partly desirable and partly necessary. Such hydroxycarboxylic acids comprise the group of lactic acid, tartaric acid, citric acid and malic acid. Difficulties arise, however, in preparing such mixed esters with a high degree of hydrophilicity. One reason for this is that these so-called "food acids" possess poor solubility at times so that direct esterification reactions are possible only in exceptional cases.

The direct reaction of partial glycerides of fatty acids with citric acid is known from German Auslegeschrift 12 78 423. This process, however, has serious disadvantages and its use is therefore limited. For example, it is only possible to react, at most, 1 mole of citric acid with 1 mole of a fatty acid monoglyceride. If the molar proportion of citric acid is increased, a large portion of this acid does not participate in the reaction and precipitates from the reaction product.

If, on the other hand, attempts are made to force the reaction to proceed by increasing the temperature, the citric acid decomposes in an uncontrollable manner. As a result, the hydrophilicity of the reaction product falls off. Also, because of the by-products which are formed, the reaction products are no longer absolutely physiologically safe.

It is furthermore known that the citric acid may initially be converted with acetic anhydride into an internal acid anhydride with the simultaneous formation of the acetyl derivative, and that this anhydride may be esterified with the partial fatty esters. In so doing, however, one does not obtain the pure citric ester of the partial monoglycerides, but rather, products in which the hydroxyl group of the citric acid is acetylated. When these reaction products are stored or used, acetic acid is liberated and impairs the odor and taste of the food to which these reaction products have been added.

The object of German Pat. No. 24 55 989 is a process for the manufacture of citric acid esters of monoglycerides and/or diglycerides of fatty acids by reacting citric acid with monoglycerides and/or diglycerides of fatty acids at temperatures of 100° to 140° C. The process is characterized by the fact that the reaction is carried out in the presence of amounts of acetic acid such that a clear solution results and is maintained during the reaction.

With this process, it has become possible to manufacture citric acid esters of partial glycerides of fatty acids with a higher degree of conversion than in the German Auslegeschrift 12 78 423. However, in this process, it is also necessary to use acetic acid which, with respect to the desired products of the process, must be described as a foreign acid.

SUMMARY OF THE INVENTION

It is an object of the present invention to find a process which enables mixed esters to be manufactured from hydroxycarboxylic acids and partial glycerides of fatty acids without resorting to foreign acids which must be separated from the products of the process. The product should at the same time have a relatively high hydrophilicity. A hydrophilicity of the mixed esters corresponding to an HLB value of 6 to 13 or higher, is desired. The HLB value is a direct measure of hydrophilicity. Its determination is described in greater detail in the paper by W. C. Griffin "Classification of surface-active agents by HLB" in *J. Soc. Cosmetic Chemists* 1, 311 (1950).

A further object of the process of the present invention is to avoid reacting free hydroxyl groups with acetic anhydride, since such acetylated products split off acetic acid on storage and give the products of the reaction an undesirable taste character.

A further object of the invention is to provide products which, in the case of a suitable choice of a food acid, can be milled and remain free-flowing and do not form lumps in the milled state. Finally, the products of the present process have good odor and taste which is of particular importance for their use in the food industry.

We have discovered that these advantages can be obtained by using a process comprising either (a) esterifying one or more fruit acids from the group consisting of tartaric acid, citric acid and malic acid with lactic acid in the proportion of 1 mole of the fruit acid to at least 0.5 moles of lactic acid at a temperature from about 110° to 165° C. with removal of the water of reaction and then esterifying the resulting reaction product at a temperature from 110° to 140° C. with a partial glyceride of a fatty acid in the molar ratio of 1 mole of the fruit acid used to 0.3 to 1 mole of the partial glyceride of the fatty acid with removal of the water of reaction; or (b) esterifying the fruit acid, lactic acid and partial glyceride of a fatty acid in the molar ratios described under (a), in a single step, at a temperature from 110° to 140° C. with removal of the water of reaction.

A significant characteristic of the present inventive process is the common esterification of one or more of the named fruit acids with lactic acid.

DESCRIPTION OF THE PREFERRED EMBODIMENT

In the present process, the molar ratio of the lactic acid to the fruit acid must be at least 0.5:1. Thus, the lactic acid is not regarded as foreign acid, since it itself is one of the food acids and is incorporated as a hydroxycarboxylic acid in the mixed esters.

In the esterification step which is generally carried out without a catalyst, the only by-product formed is the water which is liberated by the esterification. The reaction water distills off at the esterification temperature. Its removal may be facilitated by applying a vacuum to the system.

The lactic acid used may be a water-containing product. The molar ratio, however, refers to the actual lactic acid. The water-containing lactic acid may be used, for example, in the usual commercial form, which contains 10 to 15 weight percent of water.

In accordance with the two versions of the present processs, it is possible to esterify the fruit acid initially with lactic acid and to esterify this mixed ester further with the partial glyceride of a fatty acid (version (a)). In the alternative, it is possible to carry out the process in one step (version (b)).

Version (a) of the process is especially used in those cases in which tartaric acid is used as the fruit acid or in which a mixture of fruit acids is used in which the molar proportion of lactic acid is high. In general, however, the one-step process, i.e., version (b), is preferred.

In version (a) of the process, the esterification of the fruit acid with the lactic acid is carried out within a temperature range of 110° to 165° C. If citric acid is used as the fruit acid or if the citric acid proportion in the mixture of fruit acids predominates, it is advisable to carry out the esterification at somewhat lower temperatures, i.e., in the temperature range of 110° to 140° C.

Since one purpose of the inventive process is the manufacture of products of the highest hydrophilicity containing a high proportion of food acids, it is advantageous to use a partial glyceride of a fatty acid containing at least 50 weight percent of a monoglyceride of a fatty acid as an esterification component.

If the primary object is the manufacture of millable products, that is, of solid brittle products which, in the milled state, are free-flowing, lump-free powders, the use of partial glycerides of higher fatty acids and especially of stearic acid and/or palmitic acid, is preferred. Such millable, hard and brittle products are obtained especially when using tartaric acid and/or malic acid as the fruit acid.

To maintain the purity of the products of the process, the esterification is, as has already been explained, carried out preferably without catalysts. For certain areas of application and especially for uses outside of the food industry, it is also possible to use known catalysts. Examples of such catalysts are alkali hydroxides or carbonates or alkali salts of fatty acids.

The reaction time for carrying out the inventive process generally is three to six hours. Further treatment of the processed products, such as, a deodorizing treatment, is not required.

The processed products still have three carboxyl groups which can be partly or completely neutralized with alkali hydroxides or other basic reacting alkali salts. By such means, it is, in addition, possible to selectively adjust the hydrophilicity and the final properties, such as, for example, the emulsifying ability.

A special property of the products prepared from the present process wherein the fruit acid used was solely or partly composed of citric acid, is their ability to have a thickening effect in aqueous preparations. By such means, an additional increase in emulsion stability is achieved.

The inventively prepared products fulfill the above-described requirements in respect to purity and have the desired behavior in use.

The inventive process is described in still greater detail by means of the following examples. In these examples, tartaric acid, citric acid and malic acid are used in the anhydrous form as co-reactants. The lactic acid is used as an 88% solution with 12% water. The glycerol monostearate used is molecularly distilled and contains 90 weight percent of the monoester along with 10% of the diester. The glycerol monodistearate has a monoester content of 50 weight percent. Wherever the amount of lactic acid used is given in moles, this quantity refers to 100% lactic acid.

At the end of each example, some properties (at 22° C), of the 3% aqueous solution of the products obtained are given. The term, aqueous solution, is understood to include also a colloidal or finely dispersed distribution in water. Example 1-8 correspond to version (a) of the present process.

EXAMPLE 1

450 g of tartaric acid (3 moles) and 612 g of lactic acid (6 moles) are heated for one hour at 160° to 165° C., mixed with 400 g of monostearate (1 mole) and esterified for two hours at 140° C. The bright yellow, glassy end product can be worked up to a fine particulate, dry powder; acid number=184, pH=2.3.

Aqueous solution: transparent, watery.

EXAMPLE 2

300 g of tartaric acid (2 moles) and 408 g of lactic acid (4 moles) are heated for 1½ hours at 140° C., mixed with 400g of monostearate (1 mole) and esterified for 2½ hours at 135° C. The bright yellow, glassy product forms a fine particulate, dry powder; acid number=156, pH−2.4.

Aqueous solution: transparent, watery.

EXAMPLE 3

300 g of tartaric acid (2 moles) and 153 g of lactic acid (1.5 moles) are heated for 2 hours at 120° C., mixed with 400 g of monostearate (1 mole) and esterified for 3 hours at 120° C. The ivory-colored wax-like product yields a fine particulate, dry powder; acid number=172, pH=2.4.

Aqueous solution: milky, transparent, somewhat viscous.

EXAMPLE 4

150 g of tartaric acid (1 mole) and 71 g of lactic acid (0.7 mole) are heated for 1½ hours at 135° C., mixed with 400 g of monostearate (1 mole) and esterified for 3 hours at 120° C. The ivory-colored, wax-like product yields a dry, fine particulate powder; acid number=88, pH=2.6.

Aqueous solution: milky, somewhat viscous.

EXAMPLE 5

150 g of tartaric acid (1 mole) and 51 g of lactic acid (0.5 mole) are heated for 2 hours at 130° C., mixed with 400 g of monostearate (1 mole) and esterified for 4 hours at 110° C. The ivory-colored, wax-like product can be milled into a fine particulate, dry powder; acid number=88, pH=2.7.

Aqueous solution: highly viscous, milky.

EXAMPLE 6

384 g of citric acid (2 moles), 150 g of tartaric acid (1 mole) and 612 g of lactic acid (6 moles) are heated for 1½ hours at 145° C., mixed with 400 g of monostearate (1 mole), and esterified for 3 hours at 135° C. The bright yellow, glassy product yields a weakly baked powder; acid number=207, pH=2.3.

Aqueous solution: transparent, watery.

EXAMPLE 7

192 g of citric acid (1 mole), 150 g of tartaric acid (1 mole) and 204 g of lactic acid (2 moles) are heated for 2 hours at 140° C., mixed with 400 g of monostearate (1 mole) and esterified for 3 hours at 130° C. The glassy, bright yellow product can be worked up into a fine particulate, dry powder; acid number=150, pH=2.5.
Aqueous solution: milky, transparent, slightly viscous.

EXAMPLE 8

150 g of tartaric acid (1 mole) 192 g of citric acid (1 mole) and 306 g of lactic acid (3 moles) are heated for 2 hours at 140° C., mixed with 470 g of a 50% glycerol mono/distearate (1 mole) and esterified for 2½ hours at 135° C. The glassy, amber-colored product can be milled to a fine particulate powder; acid number=201, pH=2.4.
Aqueous solution: milky, transparent, slightly viscous.

Examples 9 to 13 correspond to version (b) of the present process.

EXAMPLE 9

576 g of citric acid (3 moles), 612 of g of lactic acid (6 moles) and 400 g of monostearate (1 mole) are esterified for 4 hours at 125° C. The glassy, yellowish-white product yields a slightly sticky powder; acid number=260, pH=2.2.
Aqueous solution: transparent, watery.

EXAMPLE 10

384 g of citric acid (2 moles), 204 g of lactic acid (2 moles) and 400 g of monostearate (1 mole) are esterified for 5 hours at 120° C. The ivory-colored product yields a slight sticky powder; acid number=220, pH=2.1.
Aqueous solution; milky, transparent, hardly flows (The product has a high viscosity-increasing effect.)

EXAMPLE 11

192 g of citric acid (1 mole), and 102 g of lactic acid (1 mole) and 400 g of monostearate (1 mole) are esterified for 3½ hours at 140° C. The wax-like, ivory-colored product is slightly sticky in powder form; acid number=160, pH=2.2.
Aqueous solution: milky, pasty, (The product has a strong thickening effect.)

EXAMPLE 12

192 g of citric acid (1 mole), 75 g of tartaric acid (0.5 moles), 102 g of lactic acid (1 mole) and 400 g of monostearate (1 mole) are esterified for 5 hours at 130° C. The wax-like, ivory-colored product may be worked up to a dry, fine particulate powder; acid number=167, pH=2.6.
Aqueous solution: milky, transparent, slightly viscous.

EXAMPLE 13

100 g of tartaric acid (0.67 moles), 128 g of citric acid (0.67 moles), 90 g of malic acid (0.67 moles), 204 g of lactic acid (2 moles) and 400 g of monostearate (1 mole) are esterified for 4 hours at 135° C. The whitish, glassy product yields a dry, fine particulate powder; acid number=153, pH=2.5.
Aqueous solution: milky, transparent, viscous.

What is claimed is:

1. A method for the manufacture of mixed esters from hydroxycarboxylic acids and partial glycerides of fatty acids which comprises:

(a) esterifying at least one fruit acid selected from the group consisting of tartaric acid, citric acid and malic acid with lactic acid in the proportion of 1 mole of fruit acid to at least 0.5 moles of of lactic acid at a temperature from about 110° to 165° C. and removing the water of reaction during the reaction; and (b) esterifying the resulting reaction product at 110° to 140° C. with a partial glyceride of a fatty acid in a molar ratio of 1 mole of the fruit acid to 0.3 to 1 mole of the partial glyceride of the fatty acid and removing the water of reaction during this reaction.

2. A method for the manufacture of mixed esters from hydroxycarboxylic acids and partial glycerides of fatty acids which comprises; esterifying at least one fruit acid selected from the group consisting of tartaric acid, citric acid and malic acid with lactic acid in the proportion of 1 mole of fruit acid to at least 0.5 moles of lactic acid and with a partial glyceride of a fatty acid in a molar ratio of 0.3 to 1 mole of partial glyceride per mole of fruit acid and removing the water of reaction during the esterification.

3. The process of claim 1 wherein the esterification of the fruit acid with lactic acid is carried out at temperatures of 110° C. to 140° C.

4. The process of claims 1 or 2 wherein the partial glyceride of the fatty acid is an ester containing at least 50 weight percent of the monoglyceride of the fatty acid.

5. The process of claims 1 or 2 wherein the partial glyceride of the fatty acid is an ester of stearic or palmitic acid.

* * * * *